US005355570A

United States Patent [19]

Böhmer

[11] Patent Number: 5,355,570

[45] Date of Patent: Oct. 18, 1994

[54] METHOD FOR THE PRODUCTION OF BRIGHT ROUND STEEL

[75] Inventor: Bruno Böhmer, Erkrath, Fed. Rep. of Germany

[73] Assignee: SMS Schloemann-Siemag Aktiengesellschaft, Dusseldorf, Fed. Rep. of Germany

[21] Appl. No.: 46,518

[22] Filed: Apr. 12, 1993

Related U.S. Application Data

[63] Continuation of Ser. No. 763,207, Sep. 20, 1991, abandoned.

[30] Foreign Application Priority Data

Sep. 20, 1990 [DE] Fed. Rep. of Germany ..... 4029786

[51] Int. Cl.[5] ..... B23D 79/02; B21B 15/00; B23P 25/00

[52] U.S. Cl. ..... 29/81.09; 29/81.04; 29/527.4; 29/527.7; 72/40

[58] Field of Search ..... 29/33 F, 81.01, 81.03, 29/81.04, 81.09, 527.4, 527.7, DIG. 7, DIG. 34, DIG. 36; 72/39, 40, 41, 52–56, 68; 148/12 R, 12 B, 12 E, 12 EA; 15/88

[56] References Cited

U.S. PATENT DOCUMENTS

| | | | |
|---|---|---|---|
| 3,073,022 | 1/1963 | Bush et al. | 29/DIG. 36 X |
| 3,701,677 | 10/1972 | Miyata et al. | 29/DIG. 36 X |
| 4,037,446 | 7/1977 | Fangmeier | 72/68 |
| 4,768,280 | 9/1988 | Palmer et al. | 29/527.4 |
| 4,885,042 | 12/1989 | Kenmochi et al. | 148/12 EA X |
| 5,036,689 | 8/1991 | Sekiya et al. | 72/39 |

*Primary Examiner*—Peter Dungba Vo
*Attorney, Agent, or Firm*—Anderson Kill Olick & Oshinsky

[57] ABSTRACT

A method for producing bright steel, particularly bar-shaped bright round steel produced from hot-rolled steel. The method includes rounding the round steel coming from rolling heat in a sizing mill to close tolerances, extensively removing the oxide film of the round steel and subsequently subjecting the round steel to a straightening and polishing procedure.

6 Claims, No Drawings

METHOD FOR THE PRODUCTION OF BRIGHT ROUND STEEL

This is a continuation of application Ser. No. 07/763,207, filed Sep. 20, 1991, abandoned.

BACKGROUND OF THE INVENTION

1. Field of the Invention

The present invention relates to a method for the production of bright or cold-drawn steel, particularly bar-shaped bright round steel produced from hot-rolled steel.

2. Description of the Related Art

Bright steel, particularly bright round steel, is a rolled or wrought bar steel with a metallically bright surface. Surface quality is usually divided into technical quality classes which are determined by allowable dimension tolerances, e.g. according to German Industrial Standard DIN 668 corresponding to International Standard (JSO Tolerance group h11 ). The metallically bright surface of the steel is conventionally produced by means of peeling or bright-drawing. Bright-drawing is a process for the production of drawn steel in which the oxide film on the surface is removed and a non-cutting cold forming is affected. Stands suited for this method are drawing rolling mills in which a coiled rolling material is drawn through the non-driven rolls of a roll stand. Drawing benches, which are outfitted with correspondingly shaped drawing tools are also known as suitable machine tools for the production of bright steel.

The peeling of the round steel for producing a bright surface is a cutting process and is affected on so-called peeling machines which are outfitted with correspondingly shaped peeling knives and with guiding and driving rolls. Peeling of the round steel is a step which always involves material loss, even with steel qualities which have not undergone any surface decarburization of the skin and thus need not, necessarily, be treated by material removal.

The investment costs for a drawing rolling mill, a drawing bench, or a peeling machine are high, as are the continuous tooling costs for scalping knives, guide and driving rolls, etc. In addition, there is the fact that the discontinuous operation in drawing and the requirements of devices arranged upstream and downstream make it difficult to incorporate the aforementioned processing machinery in the layout of production-line finishing.

SUMMARY OF THE INVENTION

Therefore, it is the object of the invention to avoid the disadvantages of peeling or drawing, particularly of rolled round steel, for producing a metallically bright surface and to provide a method by which bright round steel can be produced directly from hot-rolled round steel, specifically with the use of devices which are already present in secondary treatment lines of round steel production.

This object is met in a method of the above-mentioned type by rounding the round steel coming from rolling heat in a sizing mill to close tolerances, extensively removing the oxide film of the round steel and subsequently subjecting the round steel to a straightening and polishing procedure.

Surprisingly, it has been found that a round steel with bright surface, whose surface quality is comparable to the surface quality of bright-drawn or peeled round steel, can be produced by means of the suggested steps.

Bending tests on the bright round steel produced according to the invention also showed no deviations from peeled or drawn material. Thus, it can be pointed out as a substantial economic advantage that the bright round steel produced with the suggested method corresponds to the relevant DIN regulations according to the quality classes. The high investment and maintenance costs for special machinery for discontinuous, non-cutting treatment of the surface of the round steel are avoided, and the loss of expensive material occurring in peeling round steel are prevented. Thus, with the use of devices which are already present in secondary treatment lines in the production of round steel, a bright round steel can be continuously produced directly from the rolling heat without any material loss.

DETAILED DESCRIPTION OF THE INVENTION

In accordance with an advantageous further development of the invention, the round steel is round-rolled in a high-precision rolling mill to a roundness of between 0.1% and 1%. It has proven advantageous that the rolling tolerance with respect to the roundness error, range within the suggested tolerance limits, i.e. Roundness in percentage points represents a deviation of an actual cross-section of a round stock from a cross-section of an ideal circle, determined as a percentage of the nominal diameter of the ideal circle; that the rolled steel already be as round as possible, so that the concluding straightening and polishing procedure in a straightening and polishing machine is not impaired. If the tolerance limits for the roundness error are adhered to, an oscillation of the straightening rolls of the straightening machine is prevented and accordingly a negative influencing of the surface, e.g. due to chatter marks, is prevented.

The suggested method is advantageously further developed in that the descaling of the surface of the round steel is carried out up to a degree of descaling corresponding to class A Sa 2.5 according to Swedish STANDARD SIS 05 59 00 -167 which sets forth pictorial surface preparation standards for painting steel surfaces. This standard classifies steel surfaces in accordance with degrees (four) of rust, and quality classes within each degree of rust. Thus A Sa 2.5 designates a degree of rust A and a quality class Sa 2.5, where A is a degree of rust at which a steel outer surface is completely covered with sticking scales and is substantially free of rust, and Sa 2.5 is a quality class characterizing a surface having the residues, which appear only as shadows or stripes after an appropriate treatment. In other words, if the surface of the finished round steel is to be as bright as possible, the rolling material must also be as free of scales as possible, so that rust and impurities are also completely removed so that residue appears merely as shadows or stripes. This requirement can be met in an advantageous manner when the round steel is descaled in a fan blower descaling installation. It has proven particularly advantageous if wire shot having a diameter of 0.4 to 0.8 mm, preferably 0.6 mm, is used as blasting medium for descaling the round steel in the fan blower descaling installation. An optimal descaling of the surface of the round steel is achieved without pitting the latter by means of a blasting medium selected in the suggested manner. It is within the scope of the present invention that the surface of the round steel be treated by means of pickling, bright annealing, or the like prior to the straightening and polishing procedure.

According to another development of the invention, it is suggested that the surface roughness, $R_Z$, of the round steel, (defined as the average of the absolute values of the heights of the five highest section peaks and the absolute values of the depths of the five deepest section valleys within the reference range), be adjusted in the straightening and polishing machine to values between $1\mu \leqq R_Z \leqq 8\mu$. Tests have shown that the adjusting forces and the straightening forces of the rolls of the straightening and polishing machine can be adjusted to the degree that the suggested values for the surface roughness can be adhered to without difficulty. The values adjusted with the straightening and polishing machine for the surface roughness allow the round steel to appear extremely bright. The surface of the round steel is accordingly suited for further processing. Further, tests have shown that if the suggested roundness errors are not exceeded in the rolling process, this roundness error is additionally reduced in the order of magnitude of 20% to 30% in the subsequent straightening and polishing procedure.

The novel features which are considered as characteristic for the invention are set forth in particular in the appended claims. The invention itself, however, together with additional objects and advantages thereof, will be best understood from the following description of a specific example, it being understood that the example is given by way of illustration and not of limitation.

EXAMPLE

A hot-rolled round steel of 22 mm diameter was rolled in a last pass in a high-precision rolling mill, and a roundness error according to a three-point measurement of 0.09 mm was maintained. This round steel was then descaled in a commercially available fan blower descaling installation with the use of wire shot of 0.6 mm as blasting medium to a descaling degree of A Sa 2.5 according to Swedish standard SIS 05 59 00 -167. The descaled round steel was then subjected to a straightening and polishing procedure in a straightening and polishing machine. The measured surface roughness $R_Z$ was 2.22 $\mu$. The maximum section depth $R_m$, i.e. the distance of the lowest point of the surface section from the center line within the reference range was 3.52$\mu$. The arithmetic average peak-to-valley value Ra of the absolute values of the section deviations within the reference range was 0.24 $\mu$. All values were evaluated according to DIN 4762 (JSO 4287/1), which sets forth a surface roughness standard. The roughness values are determined by conventional means such as, e.g., tracer-point analyzers, optical analyzers and the like. The produced bright round steel accordingly corresponded to the quality class DIN 668.

The various features of novelty which characterize the invention are pointed out with particularity in the claims annexed to and forming a part of this disclosure. For a better understanding of the invention, its operating advantages, and specific objects attained by its use, reference should be had to the drawing and descriptive matter in which there is illustrated and described a preferred embodiment of the invention.

I claim:

1. A method of producing a bright round steel produced from a hot-rolled steel, said method comprising the steps of:

round-rolling a bright round steel coming from rolling heat in a high-precision mill to a roundness of between 0.1% and 1%;

extensively removing oxide film from the round-rolled steel; and thereafter, straightening and polishing a deoxidized steel;

wherein said oxide film removing step includes descaling a surface of the bright round steel until appearance of one of shadow and strip patterns.

2. A method according to claim 1, wherein said descaling step includes descaling the bright round-rolled steel in a fan blower descaling installation.

3. A method according to claim 2, wherein wire shot having a diameter of 0.4 to 0.8 mm is used as a blasting medium for descaling the rolled-rounded bright round steel.

4. A method according to claim 3, wherein the wire shot has a diameter of 0.6 mm.

5. A method of producing a bright round steel produced from a hot-rolled steel, said method comprising the steps of:

round-rolling a bright round steel coming from rolling heat in a high-precision rolling mill to a roundness of between 0.1% and 1%;

extensively removing oxide film from the round-rolled steel; and thereafter, straightening and polishing a deoxidized steel;

wherein said straightening and polishing step includes the step of adjusting a surface roughness of the deoxidized steel between 1 and 8$\mu$.

6. A method according to claim 5, wherein said descaling step includes treating of a round-rolled bright round steel by one of pickling and bright annealing.

* * * * *